US006031922A

United States Patent [19]

Tibbetts

[11] Patent Number: 6,031,922

[45] Date of Patent: Feb. 29, 2000

[54] MICROPHONE SYSTEMS OF REDUCED IN SITU ACCELERATION SENSITIVITY

[75] Inventor: George C. Tibbetts, Camden, Me.

[73] Assignee: Tibbetts Industries, Inc., Camden, Me.

[ * ] Notice: This patent issued on a continued prosecution application filed under 37 CFR 1.53(d), and is subject to the twenty year patent term provisions of 35 U.S.C. 154(a)(2).

[21] Appl. No.: 08/580,453

[22] Filed: Dec. 27, 1995

[51] Int. Cl.[7] ..... H04R 25/00; H04R 9/08

[52] U.S. Cl. ..... 381/313; 381/322; 381/95; 381/355; 381/356

[58] Field of Search ..... 381/312, 318, 381/321–330, 355, 356, 358, 357, 151

[56] References Cited

U.S. PATENT DOCUMENTS

| | | | |
|---|---|---|---|
| 3,662,124 | 5/1972 | Hassler et al. | 179/121 D |
| 4,450,930 | 5/1984 | Killion | 181/158 |
| 4,516,428 | 5/1985 | Konomi | 381/151 |
| 4,548,082 | 10/1985 | Engebretson et al. | 381/68 |
| 4,783,816 | 11/1988 | Buttner et al. | 381/68.7 |
| 4,815,560 | 3/1989 | Madaffari | 381/68.6 |
| 4,837,833 | 6/1989 | Madaffari | 381/322 |
| 5,195,139 | 3/1993 | Gauthier | 381/68.6 |
| 5,208,867 | 5/1993 | Stites | 381/205 |
| 5,319,717 | 6/1994 | Holesha | 381/322 |
| 5,335,286 | 8/1994 | Carlson | 381/151 |
| 5,548,658 | 8/1996 | Ring et al. | 381/322 |
| 5,570,428 | 10/1996 | Madaffari et al. | 381/191 |

FOREIGN PATENT DOCUMENTS

| | | | |
|---|---|---|---|
| 107843 | 5/1984 | European Pat. Off. . | |
| 466676 | 1/1992 | European Pat. Off. . | |
| 533284 | 3/1993 | European Pat. Off. . | |
| 556792 | 8/1993 | European Pat. Off. . | |
| 2 197 158 | 5/1988 | United Kingdom | 381/173 |

OTHER PUBLICATIONS

Killion, M.C., "Vibration Sensitivity Measurements on Subminiature Condenser Microphones," Journal of the Audio Engineering Society, vol. 23, No. 2, pp. 123–127, Mar. 1975.

*Primary Examiner*—Curtis A. Kuntz
*Assistant Examiner*—Rexford N. Barnie
*Attorney, Agent, or Firm*—Lahive & Cockfield, LLP

[57] ABSTRACT

An electroacoustic assembly comprising a microphone having a diaphragm and supported on a face plate susceptible to vibratory effects. Vibration sensitivity is reduced by opposing the pressure effects on the diaphragm caused, on the one hand, by vibration of the assembly in the ambient air mass and by vibration of the air mass leading from the ambient air mass to the diaphragm, and on the other hand, by vibration of the effective mass of the diaphragm, generally augmented with additional mass, and including the effect of the internal air mass adjacent the diaphragm. Applications include hearing aids in which the microphone and its support are mechanically coupled to receiver components that may impart significant motion thereto.

45 Claims, 15 Drawing Sheets

MICROPHONE SYSTEMS OF REDUCED IN SITU ACCELERATION SENSITIVITY

BRIEF SUMMARY OF THE INVENTION

This invention relates generally to microphone systems. More particularly, it relates to improved microphone assemblies having applications to in-the-ear (ITE) hearing aids. Such hearing aids include canal aids, which are worn by insertion mostly in the external auditory meatus of the wearer, and completely-in-the-canal (CIC) aids, characterized usually by an outer face mounted inwardly of the outer terminus of the auditory meatus.

In hearing aid systems the effective acceleration sensitivity of the microphone component is of major concern because of the potential for so-called mechanical oscillation in these tightly packed, low mass systems having substantial electronic gain in the loop comprising the microphone and the receiver (the electroacoustic output transducer). Typically, the receiver is a magnetic moving armature transducer having appreciable effective mass in its armature. In operation, the vibrating armature has both vibratory linear momentum and angular momentum. These momenta may be approximately canceled by corresponding momenta of another armature in a receiver system of siamese twin configuration, as described in the patent to Victoreen, U.S. Pat. No. 4,109,116. If these momenta are not canceled the entire receiver tends to vibrate, and to vibrate the microphone by mechanical coupling through the body or shell of the hearing aid. This may result in undesirable oscillation of the system.

Typically, the mounting of a receiver in a hearing aid cushions it against mechanical shock damage and attenuates somewhat the communication of vibration from the receiver to the hearing aid body or shell. In general, however, in smaller contemporary hearing aids such as canal or CIC aids, the mounting is not fully effective in providing this attenuation. Consequently it is important, in order to prevent oscillation of the system, that the effective acceleration sensitivity of the microphone be as small as possible.

Reduced acceleration sensitivity is one of the prime reasons for the almost complete dominance of electret condenser microphones in present day hearing aids. Typically the diaphragm of such microphones is a stretched membrane of biaxially oriented polyester (such as polyethyleneterephthalate) film, of roughly 1.5 micron thickness or less, and having a volume density of about 1.39 gram/cm$^3$. This corresponds to a surface density of about 212 microgram/cm$^2$. In terms of strictly diaphragm mass acceleration sensitivity, this in turn corresponds to a low frequency equivalent SPL (sound pressure level relative to 0.00002 Pascal) of only 60 dB at one G of acceleration applied to the microphone.

However, as observed in a paper by Mead C. Killion entitled "Vibration Sensitivity Measurements on Subminiature Condenser Microphones," Journal of the Audio Engineering Society, volume 23, pages 123–127 (March 1975), there are contributions to the acceleration sensitivity due to acceleration of the air mass in front of the microphone which may be significant and may, in mounted microphone systems, exceed the diaphragm mass contribution.

In the prior art the acoustically linked acceleration sensitivity observed by Killion has been accepted as unavoidable, and attention has been directed only at minimizing the diaphragm surface density by using thinner films. In such prior art microphone systems, the low frequency diaphragm mass and acoustical contributions to acceleration sensitivity have been additive.

According to the present invention, the low frequency diaphragm mass and net acoustical contributions are caused to be subtractive rather than additive, with the result that over a substantial frequency range the net acceleration sensitivity of the microphone system is less than that of diaphragm mass effects alone or of acoustical effects alone.

Accordingly, the present invention comprises an assembly including a microphone and a faceplate or similar support to which the microphone is secured. The microphone has a transducer casing which partially encloses an internal space and a diaphragm attached to the transducer casing and substantially completing the enclosure of said space. The microphone also has means supported within the transducer casing and responsive to volume displacement of the diaphragm to generate an electrical signal. The faceplate has a surface with an acoustic inlet therein open to sound waves in a sound propagating medium. The microphone is secured to the faceplate in a position whereby said internal space is located on the side of the diaphragm toward the acoustic inlet. The assembly of the invention also includes a passage for said medium communicating between said acoustic inlet and the side of the diaphragm opposite to said internal space.

DETAILED DESCRIPTION

Figure 1:
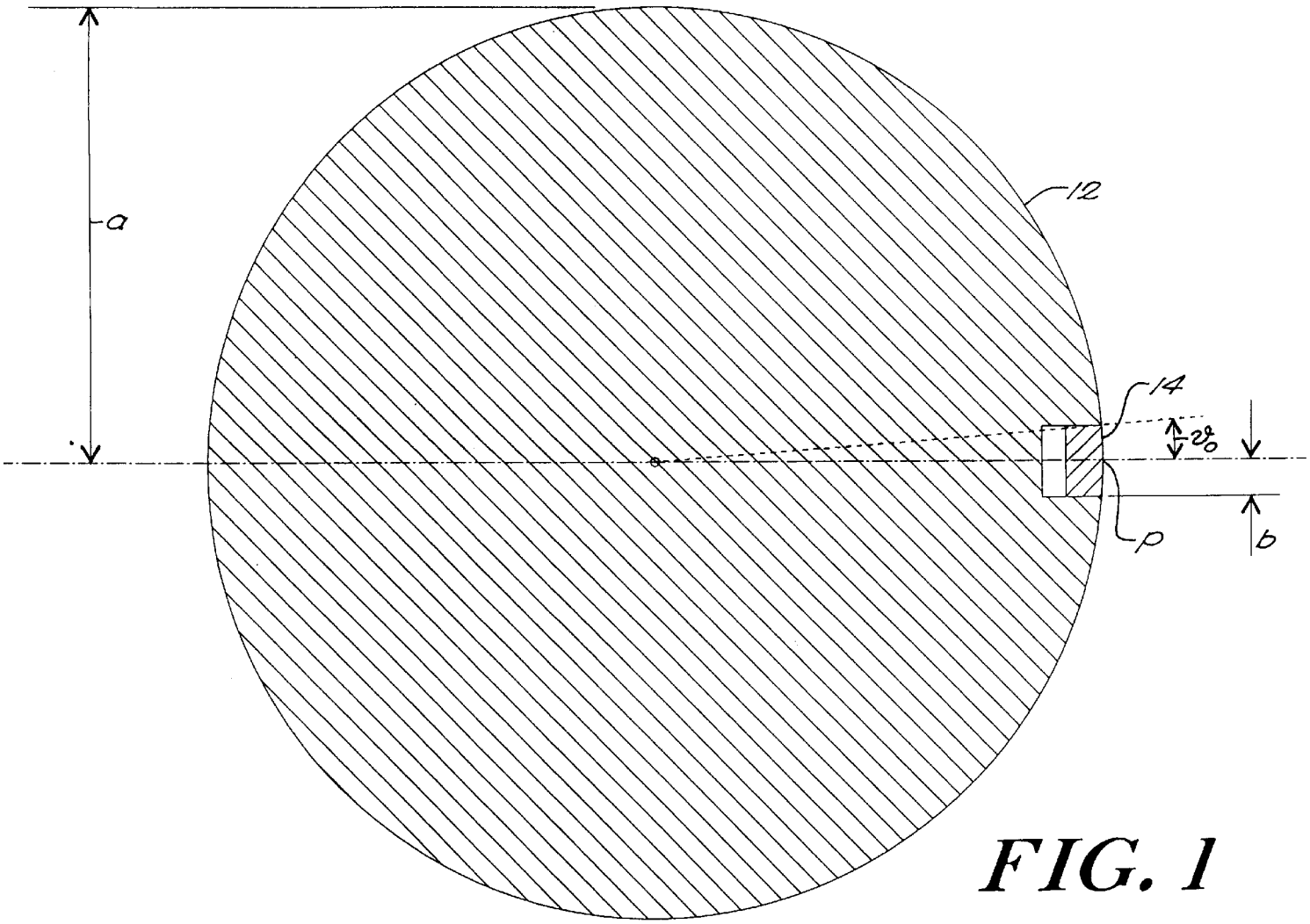
FIG. 1 illustrates the idealized axially symmetrical radiation of sound from a portion of a sphere, providing the basis for a theoretical and quantitative analysis of radiation impedance and an approximation of the conditions for a hearing aid in use.

FIG. 1 illustrates the axially symmetric radiation of sound from a portion of a sphere, assumed for purposes of explanation to approximate one of the important acoustical contributions to the acceleration sensitivity of a microphone system in an ITE hearing aid. In the results shown below, FIG. 1 together with the lossless acoustic wave equation, has a solution that is a singly infinite expansion involving products of Legendre polynomials and spherical Bessel functions, and thus is fairly readily calculable. See Morse, Vibration and Sound, 323–326 (second edition 1948).

In FIG. 1, a rigid sphere 12 of diameter 2a=15 centimeters represents the head of a hearing aid wearer. Absorption or radiation by the head, and scattering by the concha and pinna, and scattering by the neck, etc., are neglected. A circular piston 14, vibratory by translation along the axis of symmetry, and of diameter 2b=1.2 centimeter, represents the outer face of a canal aid which extends out somewhat into the concha cavum but tucks under the tragus. In particular the radiation of sound by the piston 14 represents the outward radiation of sound by a vibrating canal aid. Such vibration may result, for example, from vibration of the armature of the receiver causing the body or shell of the aid to vibrate. Note that in this model, any vibration of the piston perpendicular to the axis of symmetry results in negligible radiation, and this applies also to an actual canal aid except insofar as such vibration excites vibration of the head or outer ear. It is also recognized that axial vibrations of an ITE aid can also be expected to couple somewhat to the head.

Subject to the foregoing remarks, an analysis of the approximate system of FIG. 1 has both qualitative and quantitative significance. In the following evaluation, the inlet port of or leading to the microphone is assumed to sample the radiation pressure at a concentrated point "p" located at the center of the outer surface of the piston. In addition, the microphone is assumed to be rigidly mounted to the piston 14, so that its casing(s) undergo substantially the same vibratory acceleration as the piston. Correspondingly, in actual hearing aids the microphones of this invention are intended to be mounted rigidly to a faceplate which provides the outer surface of an ITE aid.

Figure 2:
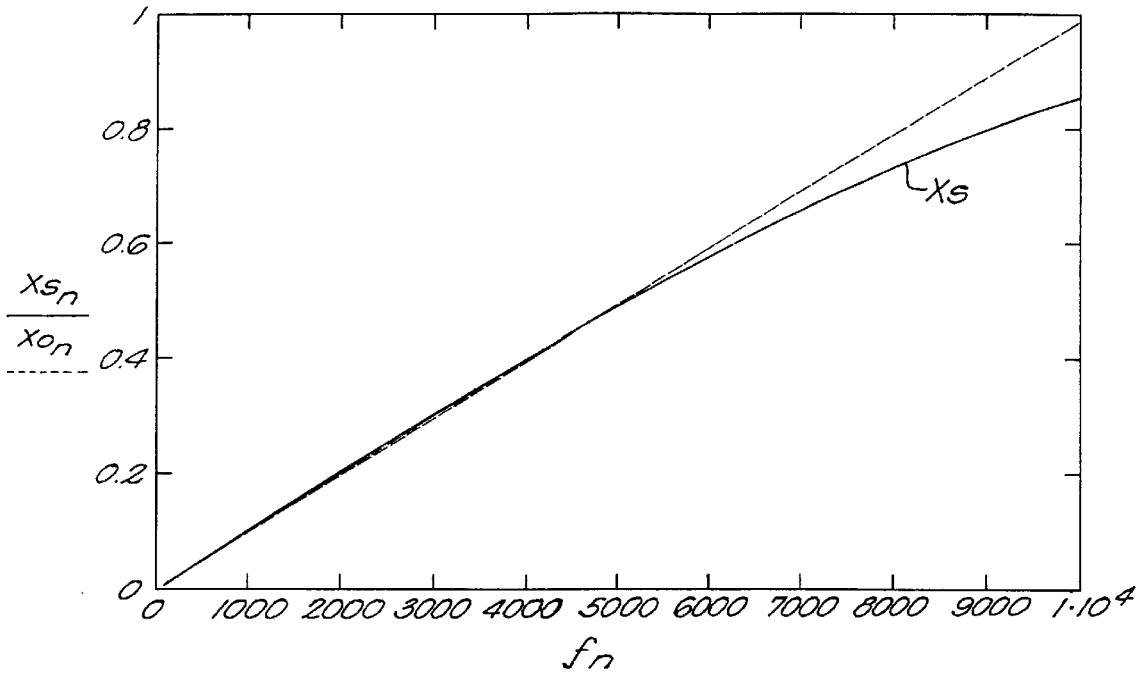
FIG. 2 is a plot of the reactive component of the radiation impedance corresponding to FIG. 1.
Figure 3:
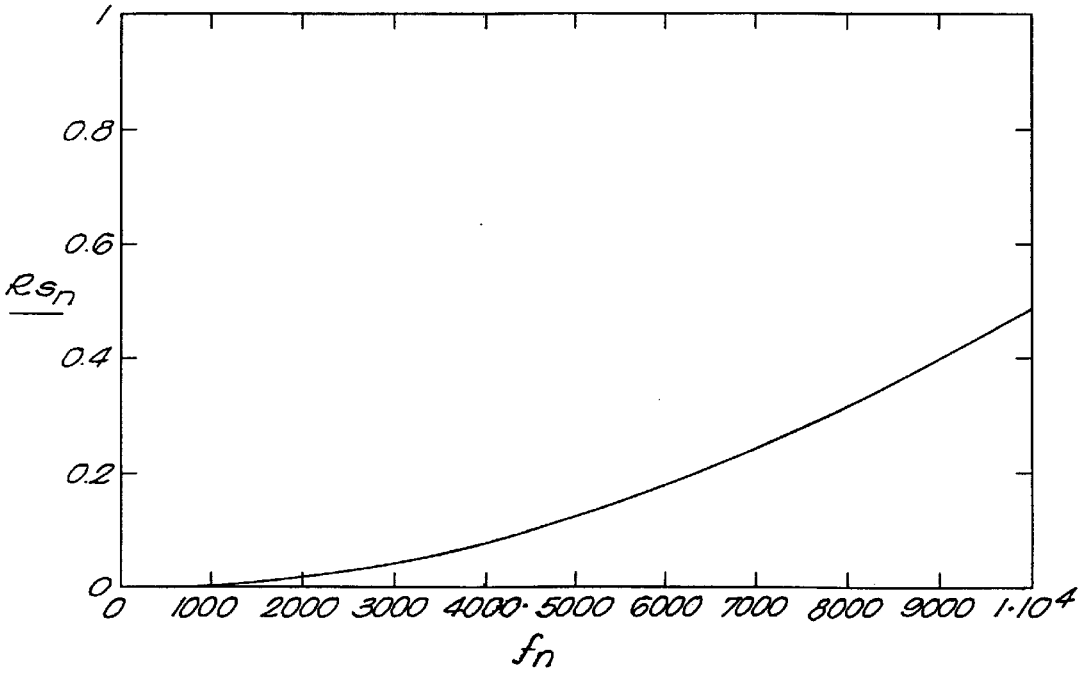
FIG. 3 is a plot of the resistive component of the radiation impedance corresponding to FIG. 1.

FIGS. 2 and 3 correspond to FIG. 1, and are linear-linear plots of the reactive and resistive components, respectively, of the specific acoustic radiation impedance. This impedance is defined as the ratio of the pressure at the center of the piston to its mechanical velocity, in each case divided by $\rho_o c$, wherein $\rho_o$ is the density of air and c is the speed of sound, both at 37° C. The range of frequency f plotted is 100 to 10,000 Hertz. The broken straight line in FIG. 2 shows the initial slope of the specific acoustic radiation reactance Xs, and helps to show that the nearly frequency proportional reactance corresponds to a nearly constant inertial effect. In fact, this slope corresponds to a pressure to acceleration ratio of $0.0740\rho_o a=6.31(10^{-4})$ g/cm$^2$, i.e. 631 micrograms/cm$^2$, about three times that of the typical diaphragm surface density noted above. There are other air masses associated with a practical microphone that in general are additive to the radiation effect, with the result that the diaphragm mass effect is almost inconsequential in contemporary prior art electret condenser microphones.

The specific acoustic radiation resistance Rs shown in FIG. 3, although relatively small at most frequencies of interest, causes a phase shift in the radiation pressure and therefore has a bearing on the subtractive inertial effects that are achieved according to the present invention. The functions Xs and Rs are accurate for the configuration of FIG. 1, but are only indicative of the radiation impedance of an actual canal aid when in use. In addition, the functions Xs and Rs depend on the diameter chosen for the piston of FIG. 1.

Figure 4:
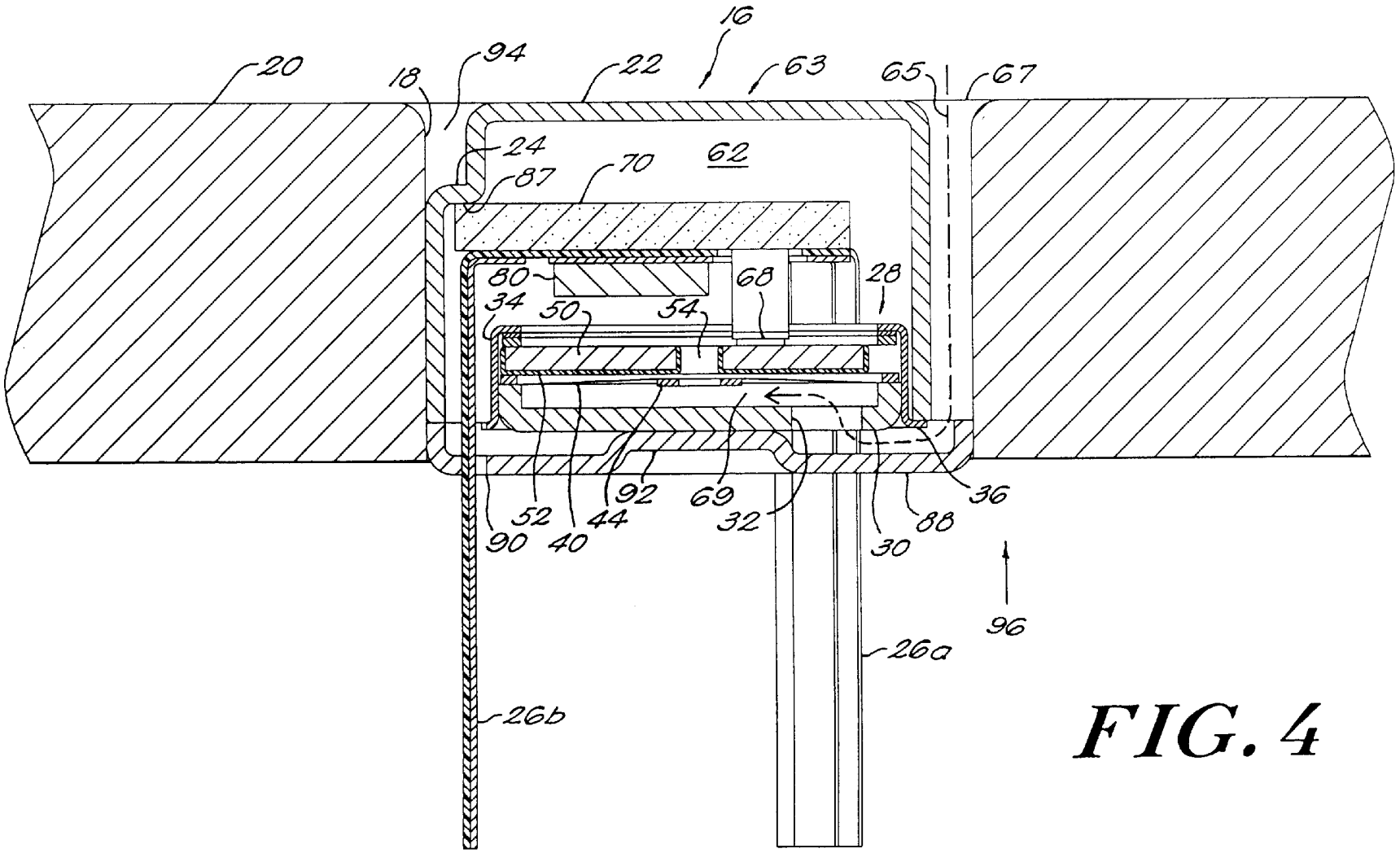
FIG. 4 is an elevation in section of a first embodiment of the invention having a microphone flush-mounted in a faceplate.
Figure 4A:
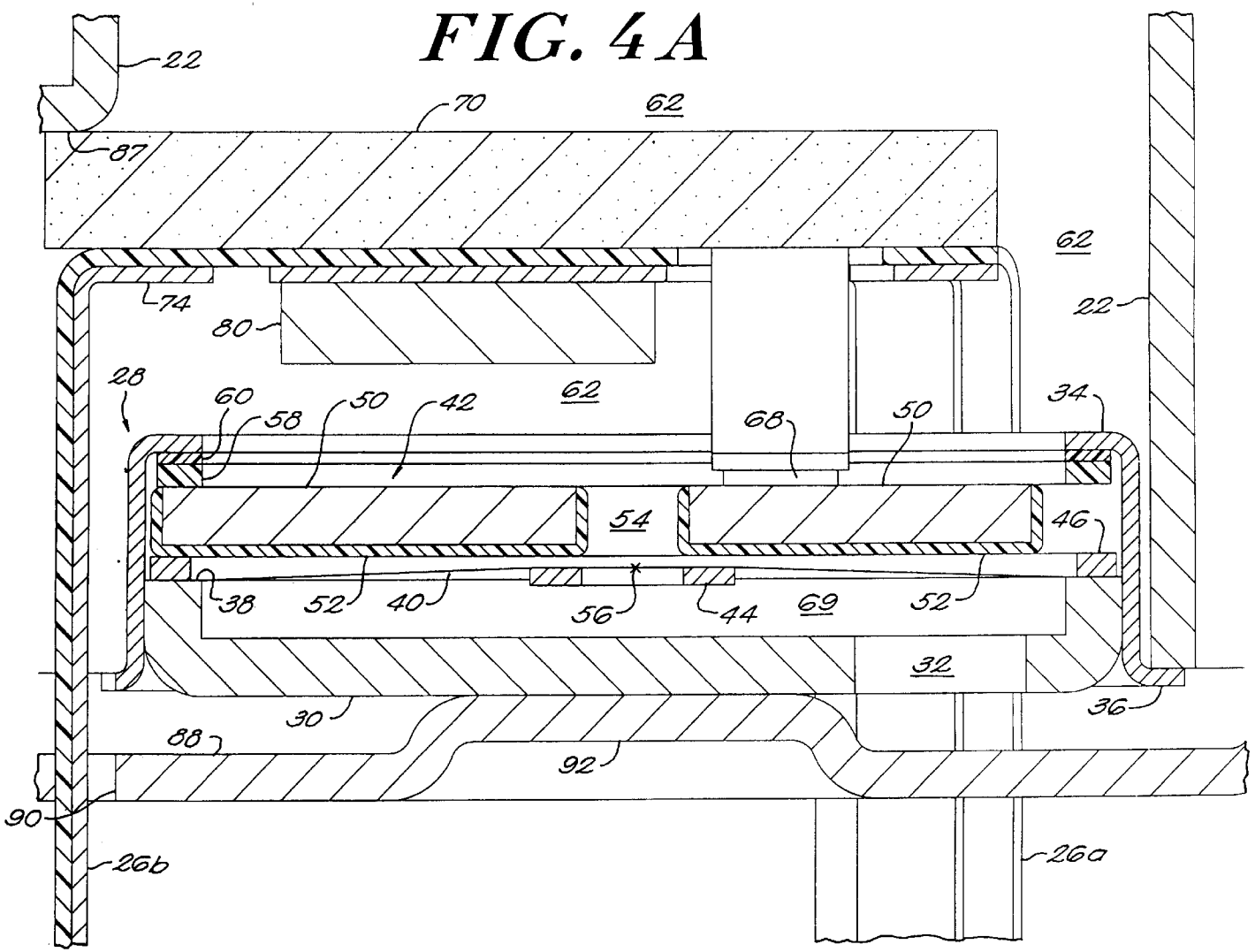
FIG. 4*a* is an enlarged detail of FIG. 4.
Figure 5:
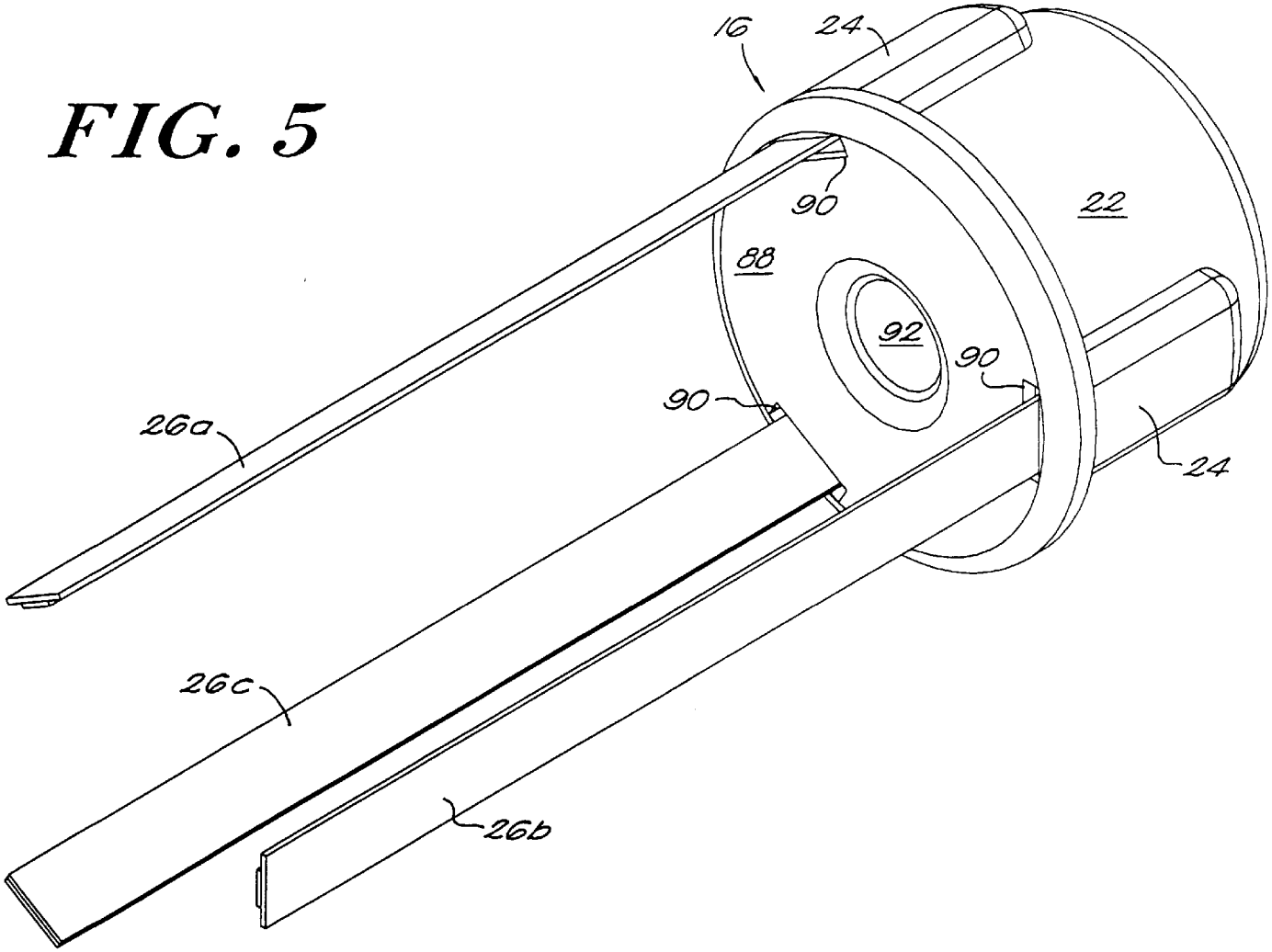
FIG. 5 is an isometric view of the microphone of FIG. 4.
Figure 6:
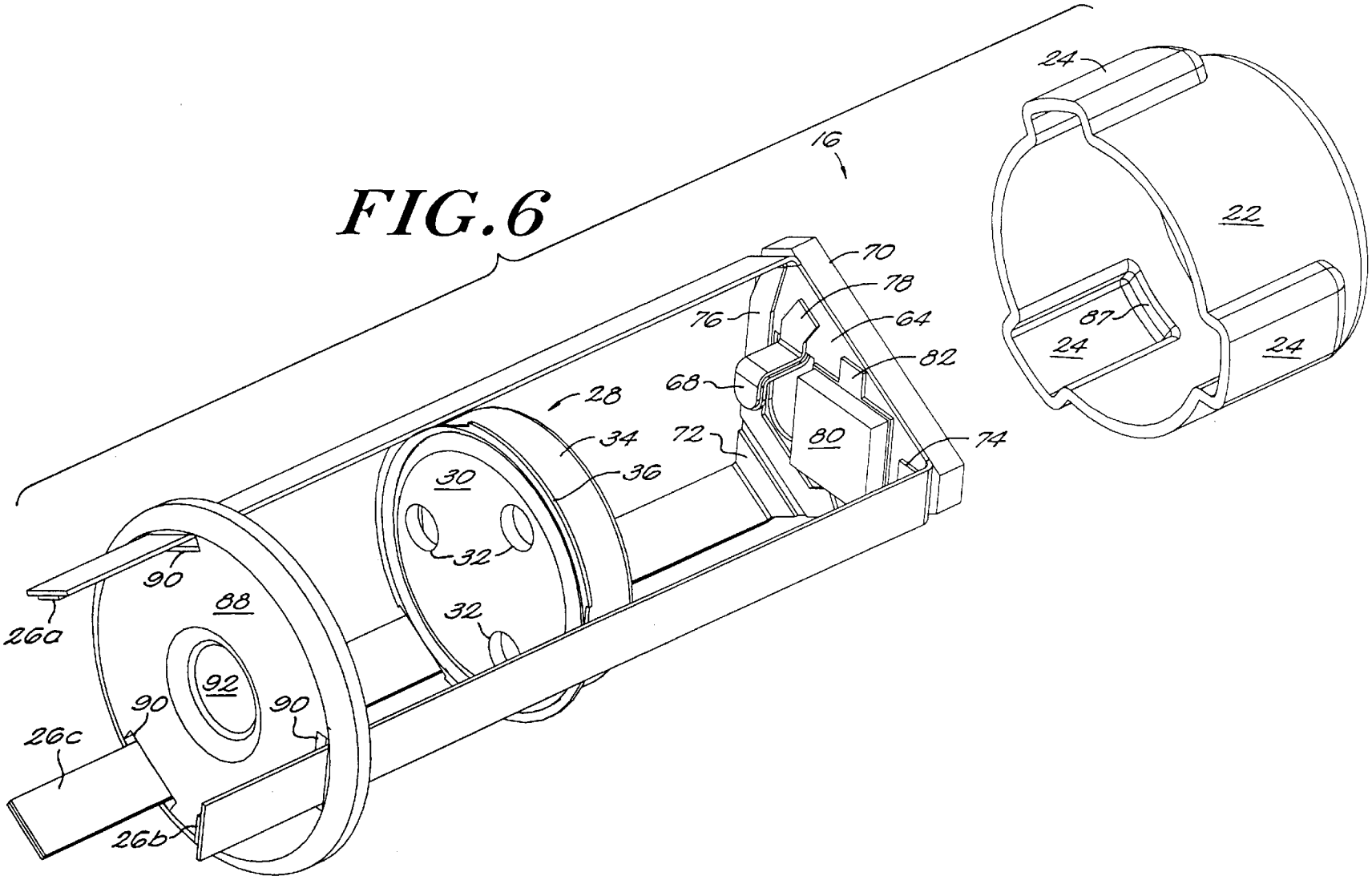
FIG. 6 is a partially exploded isometric view of the microphone of FIG. 4.
Figure 7:
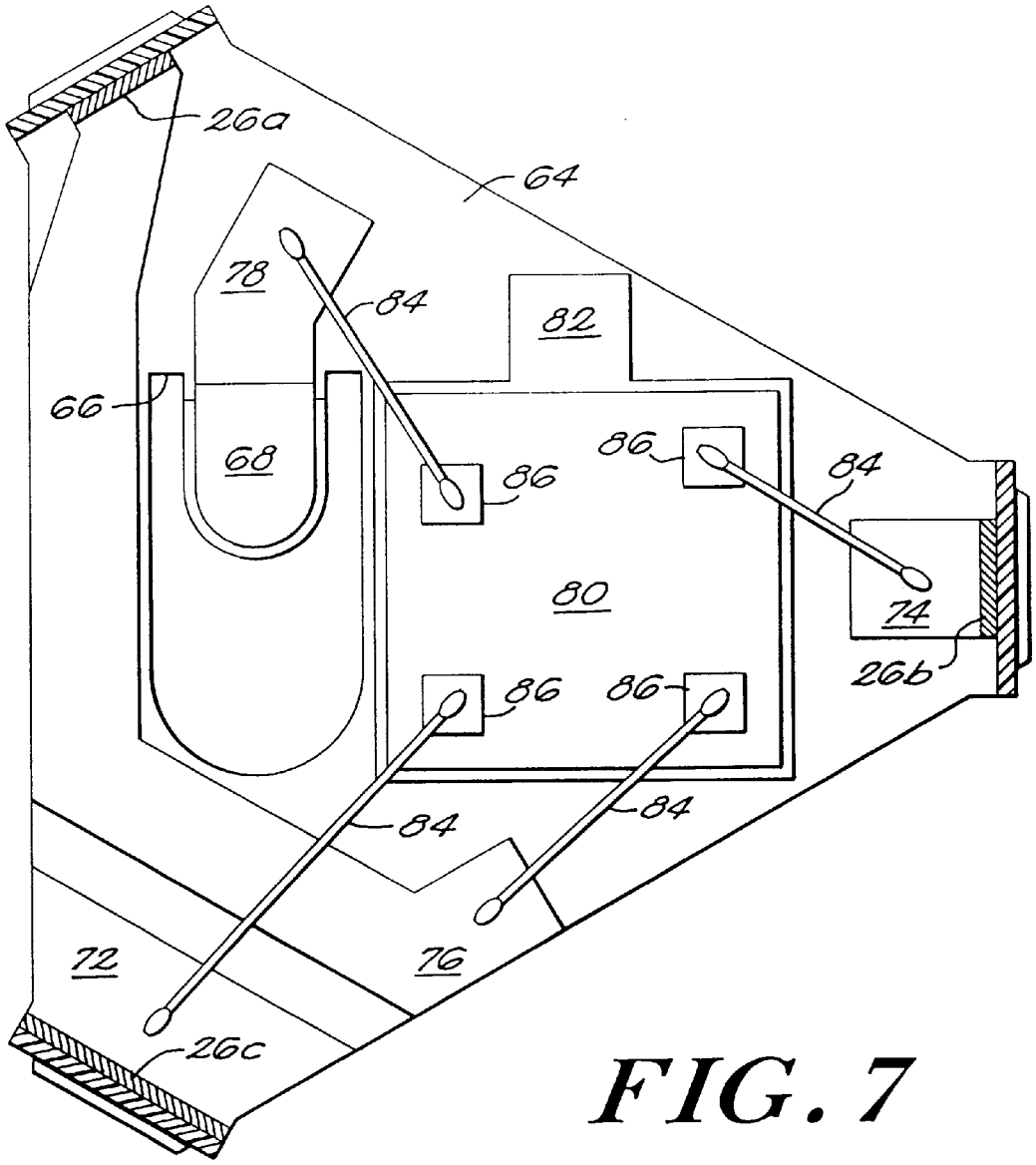
FIG. 7 is a view in plan showing circuit elements of the embodiment of FIG. 4.
Figure 8:
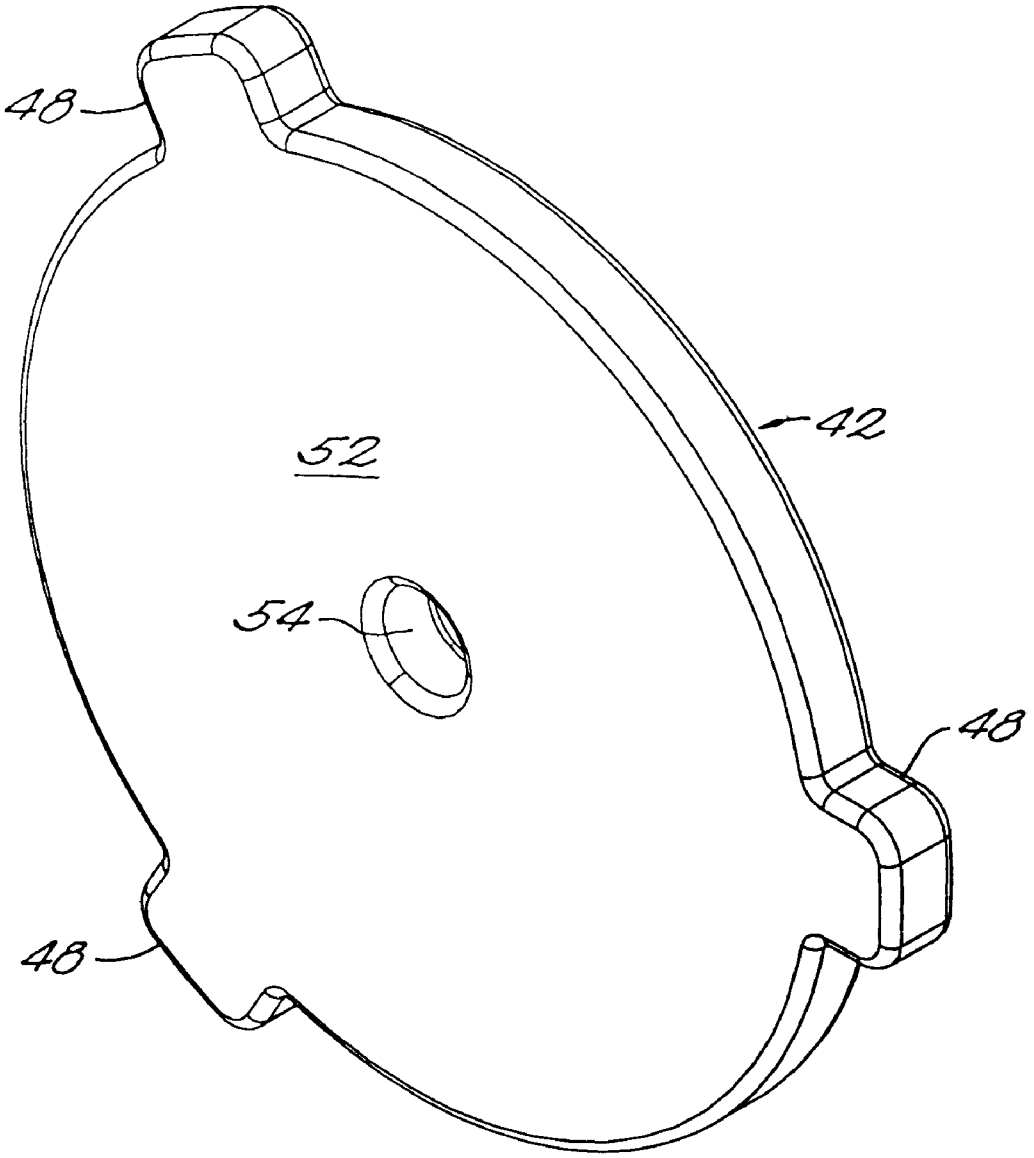
FIG. 8 is an isometric view of the backplate of FIG. 4.

A preferred embodiment of the invention, which provides a means to counteract the radiation impedance predicted by the foregoing approximate analysis, is shown in FIGS. 4, 4*a* and 5 to 8. FIG. 4 is a diametral cross section of a microphone 16 mounted in a circular aperture 18 of a faceplate 20. FIG. 4*a* is a magnified portion of FIG. 4. FIG. 5 is an isometric view of the complete microphone. FIG. 6 is a view of the microphone 16 partially exploded along its axis. FIG. 7 is a plan view of the electronic circuitry incorporated in the microphone. FIG. 8 is an isometric view of the microphone's electret coated backplate.

In this embodiment the microphone 16 has a drawn metallic casing 22 having at least three integral ridges 24 which space and mount the microphone, while allowing sound passage roughly axially along the remaining cylindrical portions of its exterior. The ridges 24 also allow passage of three flex leads 26*a*, 26*b* and 26*c* from the internal electronic circuitry of FIG. 7 to the exterior of the microphone and to electrical connections to other circuitry of a hearing aid or other electronic device.

An electret cartridge subassembly 28 has a drawn cup 30 blanked with acoustic apertures 32, and a retainer 34, drawn and blanked to form a central opening, and having a flange 36 notched locally to avoid electrical shorting of the flex leads.

The cartridge 28 is shown in more detail in FIG. 4*a*. The cup 30 is coined to sharpen its inside radius, and also to provide a flat edge 38. Typically the cup 30 is gold plated. To the edge 38 is adhesive bonded under tension a polyester film diaphragm 40 which is so thin that it is shown simply as a line in FIGS. 4 and 4*a*. The film from which diaphragm 40 is fabricated is thinly gold coated, as by vacuum evaporation, on the side which will face the cup 30. The gold coating renders the diaphragm 40 electrically conductive, and enables it to function as the movable electrode in a capacitive transducer comprising the diaphragm 40 and an electret coated backplate 42. An added mass 44 is bonded to the diaphragm for reasons discussed below. A shim washer 46, typically photoetched from metallic foil, spaces the diaphragm at its peripheral edge from the electret coated backplate at tabs 48 on the latter, shown in FIG. 8. The substrate 50 of the backplate 42 is metallic, typically gold plated to provide reliable electrical contact. An electret coating 52 on the backplate is typically a discrete film of a fluorocarbon polymer, usually a copolymer of tetrafluoroethylene and hexafluoropropylene, which is melt coated onto one major face and the edges of the backplate's substrate. Although most of the backplate 42 is spaced radially inward from the shim 46 to allow acoustic passage between the diaphragm 40 and the major interior spaces of the microphone, and also to reduce the electrical leakage capacitance between the backplate and the surrounding structure of the cartridge 28, a central aperture 54 is provided in the backplate for additional acoustic passage and reduces the acoustic damping between the diaphragm 40 and the outer face of the electret coating 52. A very small aperture 56 (FIG. 4*a*) is controllably produced, as by eximer laser, in the diaphragm 40 to provide atmospheric pressure venting of the interior spaces of the microphone. It is desirable for practical reasons to locate the aperture 56 in line with the aperture 54, and in order to do this the mass 44 is preferably in the form of a ring or washer. In FIGS. 4 and 4*a*, the thicknesses of the shim 46 and mass 44, and the degree of sag of the diaphragm 40 toward the electret coating 52 caused by electrostatic attraction, are exaggerated for the sake of clarity.

Prior to the making of the subassembly of the cartridge 28, the electret coating 52 may be negatively charged by a combination of the corona and thermal methods known in the art. The components of the cartridge 28 are completed by insulating washers 58 and 60 which space between the retainer 34 and the metallic surfaces of the tabs 48, and apply a moderate force to the tabs to ensure a stable subassembly of the electret cartridge 28 This force is maintained by welds between the retainer 34 and the cup 30, as by small laser welds through the wall of the retainer into the wall of the cup. In addition, adhesive is applied to the seam between the cup 30 and retainer 34 to acoustically seal between them. The washer 58 may be blanked from low dielectric constant film such as dispersion cast polytetrafluoroethylene. The washer 60 may be the same material as the electret coating 52, and may for convenience melt bond the washer 58 to the retainer 34. Preferably, however, the washers 58 and 60 are fabricated in one step from prelaminated or precoated film.

As above described, and upon completion of the assembly as described below, the casing 22 and parts of the cartridge 28 partially define and enclose an interconnected internal space 62 on one side of the diaphragm 40, and as such they are referred to collectively herein as the "transducer casing" 63. The diaphragm 40 substantially completes the enclosure of the space 62 except for the very small aperture 56. The spaces between the external surfaces of the casing 22 and the internal surface of the aperture 18 in the faceplate form an air passage shown by a broken line 65 leading from an acoustic inlet 67 formed at the surface of the faceplate to a chamber 69 on the side of the diaphragm opposite to the internal space 62.

A second subassembly is made before insertion in the casing 22, and comprises a circuit and lead subassembly partially detailed in FIG. 7. A laminated circuit 64, including the leads 26*a*, 26*b* and 26*c*, is photoetched in the flat from a suitable laminate such as copper foil/polyimide film. Preferably the exposed surface of the copper is gold plated, with an intermediate plating substantially suppressing the diffusion of copper into the gold plating. As part of the process of fabricating the laminated circuit 64 while flat, a U-shaped slot, partially shown at 66, is blanked in the polyimide film. This allows a connector 68 to be formed up and over in an operation that also forms up the leads 26*a*, 26*b* and 26*c*. The formed laminated circuit 64 is adhesive bonded to a mechanically stiff electrically insulating substrate 70 (FIG. 6). The substrate 70 may itself comprise a circuit board, and may be formed of a high alumina ceramic, for example.

With reference to the plan view of FIG. 7 the lead 26*c* is a ground lead and extends to a pad 72. The lead 26*b* is a power supply lead and extends to a pad 74. The lead 26*a* is an output lead and extends to a pad 76. The connector 68 extends to a pad 78. The metallic foil underlying a semiconductor amplifier die 80 extends to a pad 82, The die 80 is mechanically mounted and electrically connected at its underneath surface by silver pigmented die attach epoxy.

The pads 72, 74, 76 and 78 are connected by bond wires 84 to corresponding pads 86 as supplied on the die 80. Each of the bond wires 84 loops up away from the pair of wire bonds at its ends, especially to clear the bond wires 84 from the remaining surface of the die 80. In particular, the bond wire loop from pad 72 to its corresponding die pad 86 also clears the output conductor from lead 26*a* to pad 76, to avoid shorting the output conductor to ground.

The die 80 preferably comprises a preamplifier and may be of the type disclosed in the copending application of Madaffari and Collins, Ser. No. 08/447,349 filed May 23, 1995. In the structures of Madaffari and Collins, a shunt connected discrete capacitor typically rolls off high frequency noise, and the capacitor may be physically larger than the die 80. Although not shown in FIG. 7, such capacitor may be located on the side of the substrate 70 opposite to the die 80, and may be electrically connected to the amplifier die 80 by a wire bond to pad 82.

After appropriate cleaning operations, the die 80 and all of its bond wires 84, including the wire bonds, are encapsulated in a semiconductor grade blob top (not shown), the latter being pigmented black to render it substantially light opaque. High temperature oven cure of the blob top encapsulant completes the circuit and lead subassembly.

By means of the leads 26*a*, 26*b* and 26*c*, the amplifier circuit of the die 80 is connected to additional circuits (not shown) comprising the hearing aid receiver. Typically, the receiver includes a magnetic moving armature transducer for converting from electrical to acoustic energy, and is partially contained by an aid enclosure of which the faceplate 20 is a part.

With particular reference to FIGS. 4 and 6, the circuit and lead subassembly may now be adhesive bonded into the casing 22. Truncated corners of the substrate 70 rest on terminal flats such as 87 of the ridges 24. The leads 26*a* and 26*b* are electrically insulated from the ridges 24 by the extra width of their insulating film, but the ground lead 26*c* has full width of its foil to help enable the required reliable electrical contact of the ground lead to the casing 22. This may be accomplished by silver epoxy to the interior of the corresponding ridge 24 near the pad 72, provided that the casing 22 has a noble metal surface such as gold plating.

Next, the electret cartridge 28 may be adhesive bonded into place in the casing 22, the adhesive peripherally sealing except where the ridges 24 are located, and with the flange 36 locating the cartridge against the edge of the casing. The notches in the flange 36 are aligned with the leads 26*a*, 26*b* and 26*c*. Preferably the flange 36 is welded to the edge of the casing 22 in at least one location to establish definite electrical contact The connector 68 springs against the backplate 42 to provide electrical contact, and if desired this may be augmented with silver epoxy. Sufficient adhesive is applied between the interior of the ridges 24 and the adjacent wall of the retainer 34, near the outer edges of the ridges 24, and on both sides of the leads 26*a*, 26*b* and 26*c*, to ensure an acoustic seal at each of these regions.

The assembly of the microphone described above is completed by addition of a slotted cap 88 which, with its slots 90 threaded by the leads 26*a*, 26*b* and 26*c*, is edgewise butted against the opposing edges of the ridges 24. The outside diameter of the cap 88 is nominally the same as the diameter of the casing 22 overall including its ridges 24. Preferably the cap 88 is strongly attached to the casing 22 by small laser welds which overlap the seams between the cap and the ridges 24. The cap 88 also has a formed boss 92 which is adhesive bonded to the cup 30. The assembly is completed by adhesive which strongly bonds and seals in the slots 90 all around the flex leads 26*a*, 26*b* and 26*c* where threaded.

FIG. 4 shows the microphone 16 bonded and sealed into the hearing aid faceplate 20 within its circular aperture 18. Preferably the outer face of the casing 22 is substantially flush with the outer surface of the faceplate. Beginning with an annulus 94, passages such as 65 transmit vibratory acoustic flow to and from the front chamber 69 between the diaphragm 40 and the cup 30. The flow passages are fairly long, but their relatively large area keeps within reason the acoustic inlet impedance to the chamber 69. Thus when the microphone 16 is not vibrating as a whole, it functions in an essentially conventional manner.

When the microphone 16 is functioning in a hearing aid, it is vibrating with the faceplate 20, primarily in response to vibration of the hearing aid induced by the receiver, as discussed above. In general, a substantial component of the vibration will be along the axis of the microphone, and it is this component that causes most of the radiation pressure associated with the vibrating outer surfaces of the faceplate 20 and microphone casing 22 in combination. Thus the microphone senses two superposed pressure signals: (1) the pressure associated with waves emanating from external sources, as affected by passive scattering by the head, etc., and (2) the radiation pressure associated with hearing aid (and head) vibration, as augmented by the air masses forming the passage 65. It is the pressure (2) that is of primary concern, since it creates the potential for feedback oscillation.

The operation of the invention can be explained to an approximation by considering the operation at a low frequency in which the air masses of the passage 65, the air mass in the interior space 62 of the microphone, the mass 44, and the self-mass of diaphragm 40, all move substantially although not exactly with the microphone 16 as it vibrates. For an approximation, the radiation resistance such as Rs (FIG. 3) is neglected. On these assumptions, as the microphone 16 is accelerated in a direction 96 (FIG. 4), the radiation reactance such as Xs (FIG. 2), augmented substantially by the air masses in the passage 65, produces a positive signal pressure in the chamber 69 and an upward force in the direction 96 on the diaphragm 40. However, the acceleration in the direction 96 of the self-mass of the diaphragm 40, the mass 44, and the effective air mass in the space 62, produces a downward reaction force in and on the diaphragm 40 in the direction opposite to the direction 96. Since the substantially frequency proportional radiation reactance such as Xs corresponds to a substantially constant mass-like effect, significant cancellation of the upward and downward forces on the diaphragm 40 results, thus achieving the primary object of the present invention.

The following considerations are also pertinent to the foregoing low frequency approximation. The acoustic impedance of the vent aperture 56 in the diaphragm 40 is essentially resistive and frequency independent, and is required to be high enough to be acoustically insignificant at frequencies of interest from the point of view of cancellation of acceleration signals. Because of approximate volume conservation in the space 62, about half of the mass of air in this space is effective in producing reaction pressure on the diaphragm. Consequently the air mass effect in the passage 65 considerably outweighs that of the space 62. The added mass 44 is required to bring the cancellation effect roughly into balance, and also to individualize sufficiently the choices of microphones available. The slope of the radiation reactance such as Xs depends on the hearing aid face size, and also on its location in the ear, thus requiring a choice of differing masses 44. The choice of a small additional ring or washer for the mass 44 is dictated by the practical need to have a constant film thickness and elastic tension stress for the diaphragm 40. Ideally, the added mass may be distributed uniformly over the diaphragm without altering its other characteristics.

A simplified equivalent circuit model of the accelerated microphone, in which the mass 44, the self-mass of the diaphragm 40, and the effective air mass of space 62 are lumped into a single mass, indicates that complete cancellation of the acceleration signals cannot be achieved even in principle over a finite frequency range. The radiation reactance such as Xs departs from a constant slope, the radiation resistance such as Rs becomes non-negligible, and the impedance and coupling of the air masses in the passage 65 are changed by viscosity and other effects. In addition, the inductance representing approximately the radiation reactance plus the passage 65 mass effects is shunted by a capacitance representing the chamber 69 plus some of the passage 65 compressibility effects, while the lumped mass associated with the diaphragm 40 is not so shunted. However, if the resonant frequency of this inductance-capacitance pair is placed well above the required passband of the microphone, and if the Rs/Xs ratio of the radiation impedance is fairly small over that passband, a substantial degree of cancellation of the acceleration signals can be achieved over the entire passband of the microphone, and generally this is sufficient for practical applications. Although the specific acoustic radiation impedance usually is not choosable, the highest inductance-capacitance resonant frequency usually will be obtained by designing the cross sectional areas in the passage 65 as large as practical.

Figure 9:
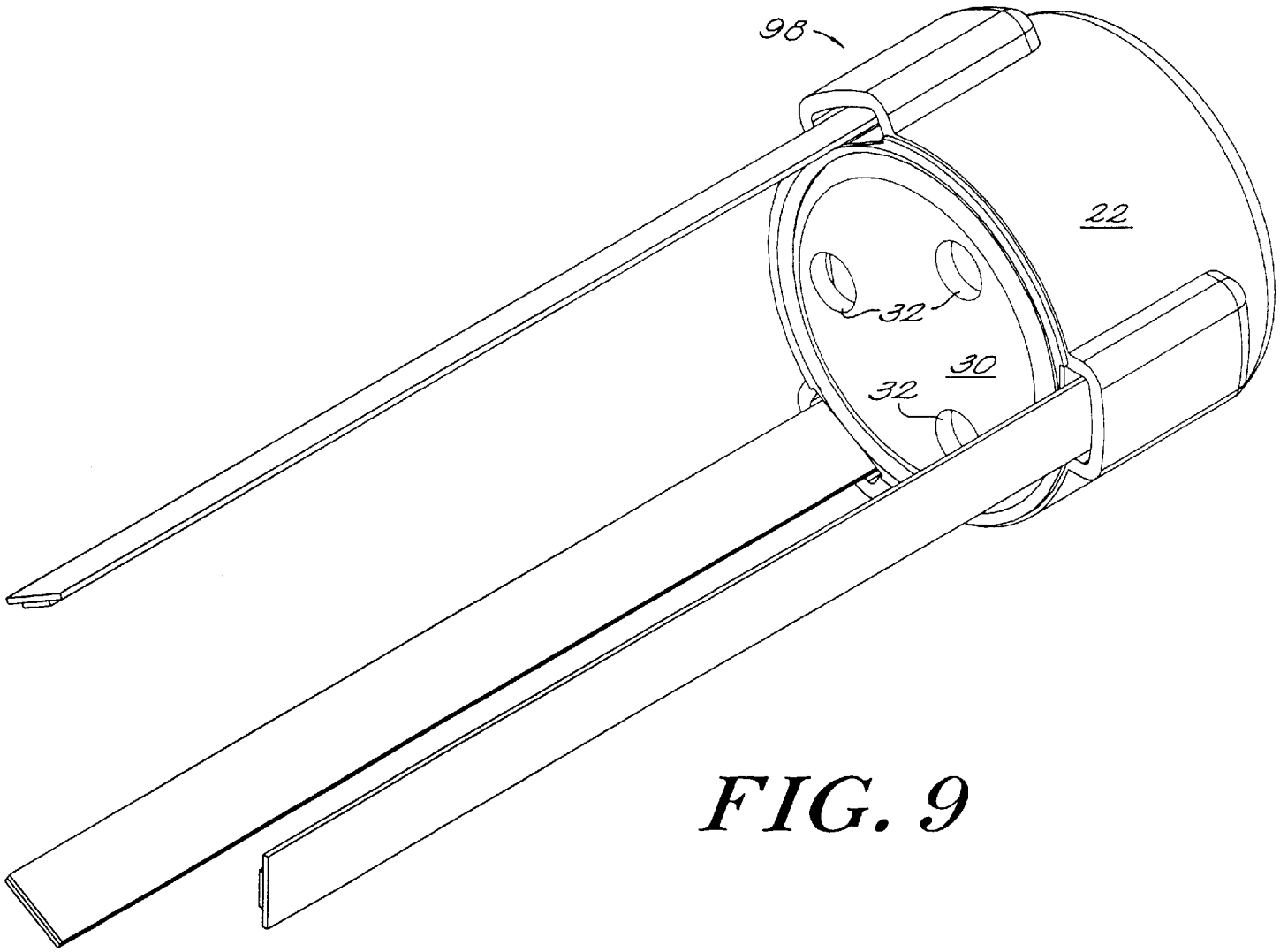
FIG. 9 is an isometric view of the microphone of FIG. 4 without the cap 88.
Figure 10:
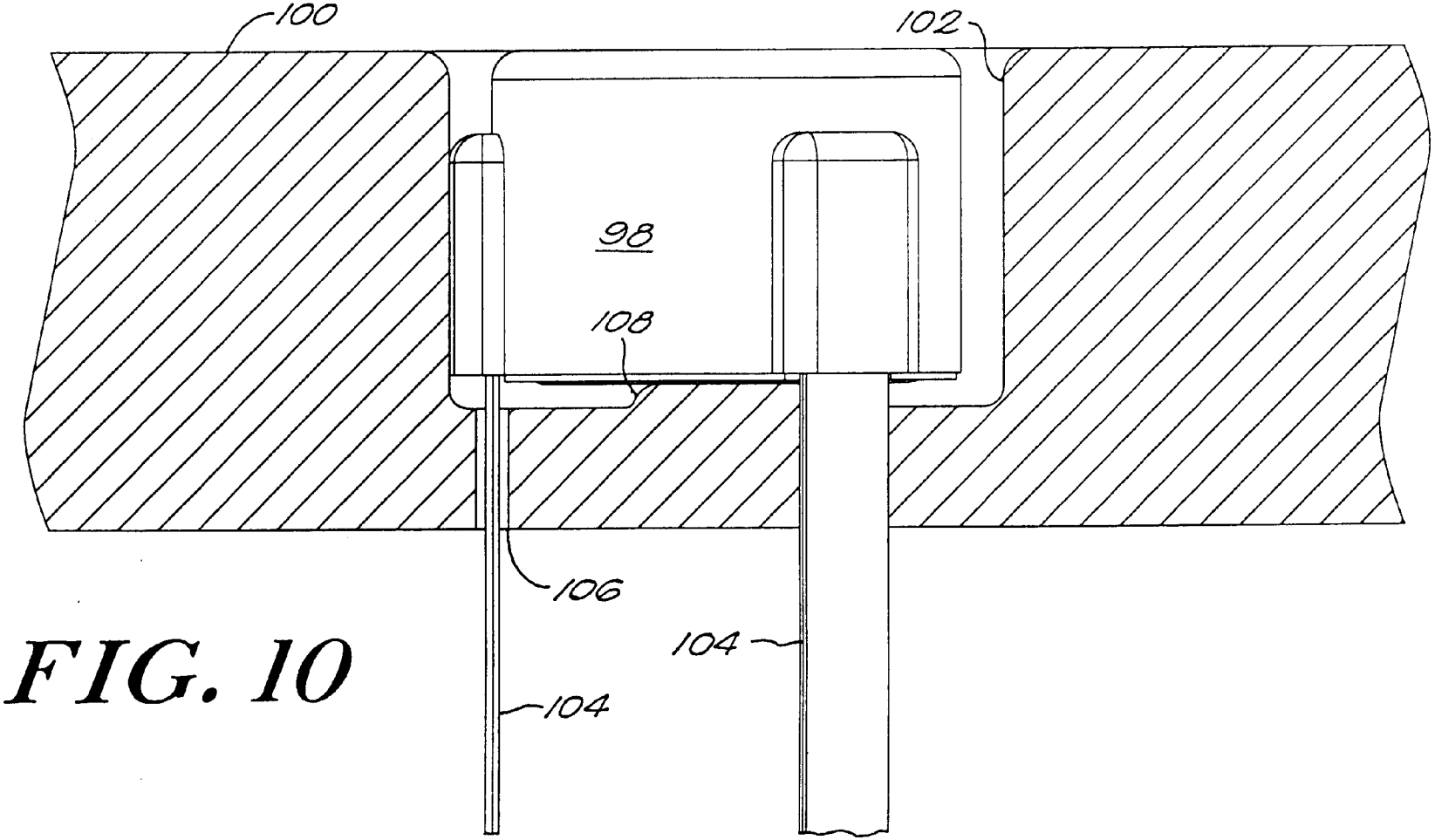
FIG. 10 is an elevation partly in section of a second embodiment of the invention.

FIG. 9 shows a microphone 98 comprising a variation of the microphone of FIGS. 4 to 7, this variation differing only in that the cap 88 is omitted. As shown in FIG. 10, the microphone 98 is adapted for mounting from the outside of a faceplate 100 in a semi-blind circular recess 102 molded in the faceplate 100, with the flex leads 104 threaded through slots 106 sealed acoustically tight by the hearing aid manufacturer around each lead. A molded boss 108 spaces the cup of the microphone 98 from the remainder of the bottom of the recess, to provide acoustic access to the apertures in the cup. This variation and its mounting avoids the tendency toward constriction of the passage 65 in the microphone (FIG. 4), between the rim of the cap 88 and the inwardly spaced portions of the rim of the casing 22.

Figure 11:
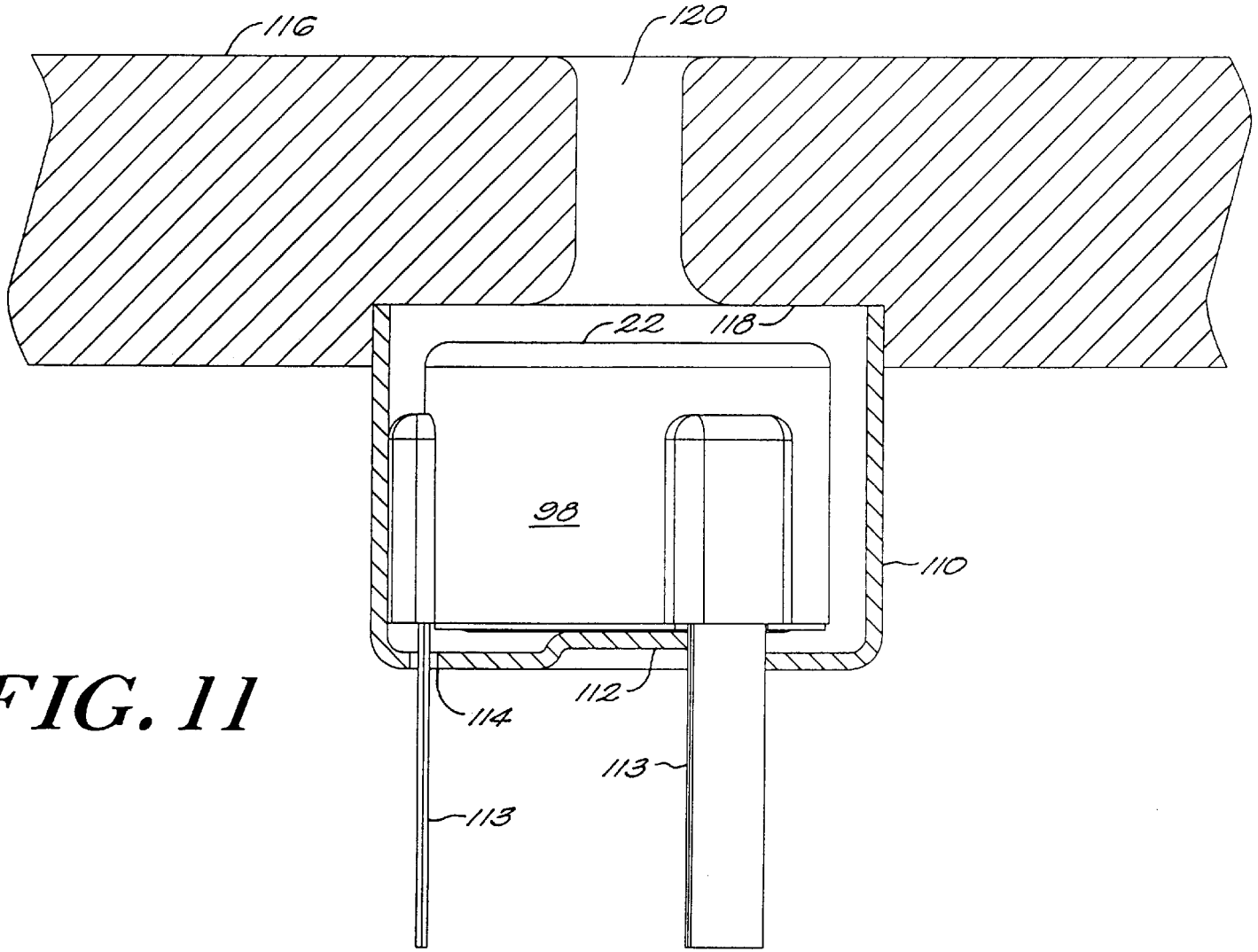
FIG. 11 is an elevation partly in section of a third embodiment of the invention.

A further variation is shown in FIG. 11, in which the microphone 98 described with reference to FIG. 10 is welded into a circular outer casing 110 which provides appropriate slots and a locating boss 112. In this embodiment the microphone 98 has its leads 113 strongly and tightly bonded into each of slots 114. This variation is for applications which require mounting on the inside of a faceplate 116. The edge of the outer casing 110 extends beyond the outside bottom of the casing 22, and this edge mounts and seals into a shallow circular recess 118 in the faceplate. An aperture 120 in the faceplate 116 provides acoustic inlet to the internal microphone 98, but also results in considerably longer acoustic passages than the passage 65 of the microphone 16 as shown in FIGS. 4 to 7.

Figure 12:
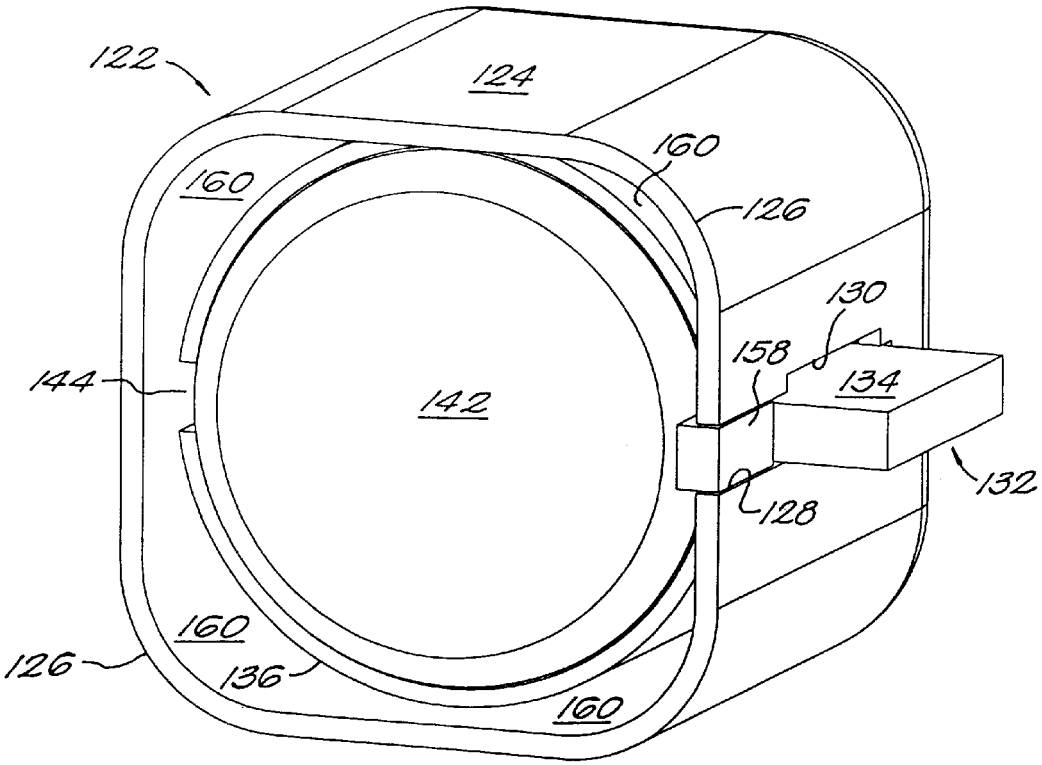
FIG. 12 is an isometric view of an alternative form of microphone according to the invention.
Figure 13:
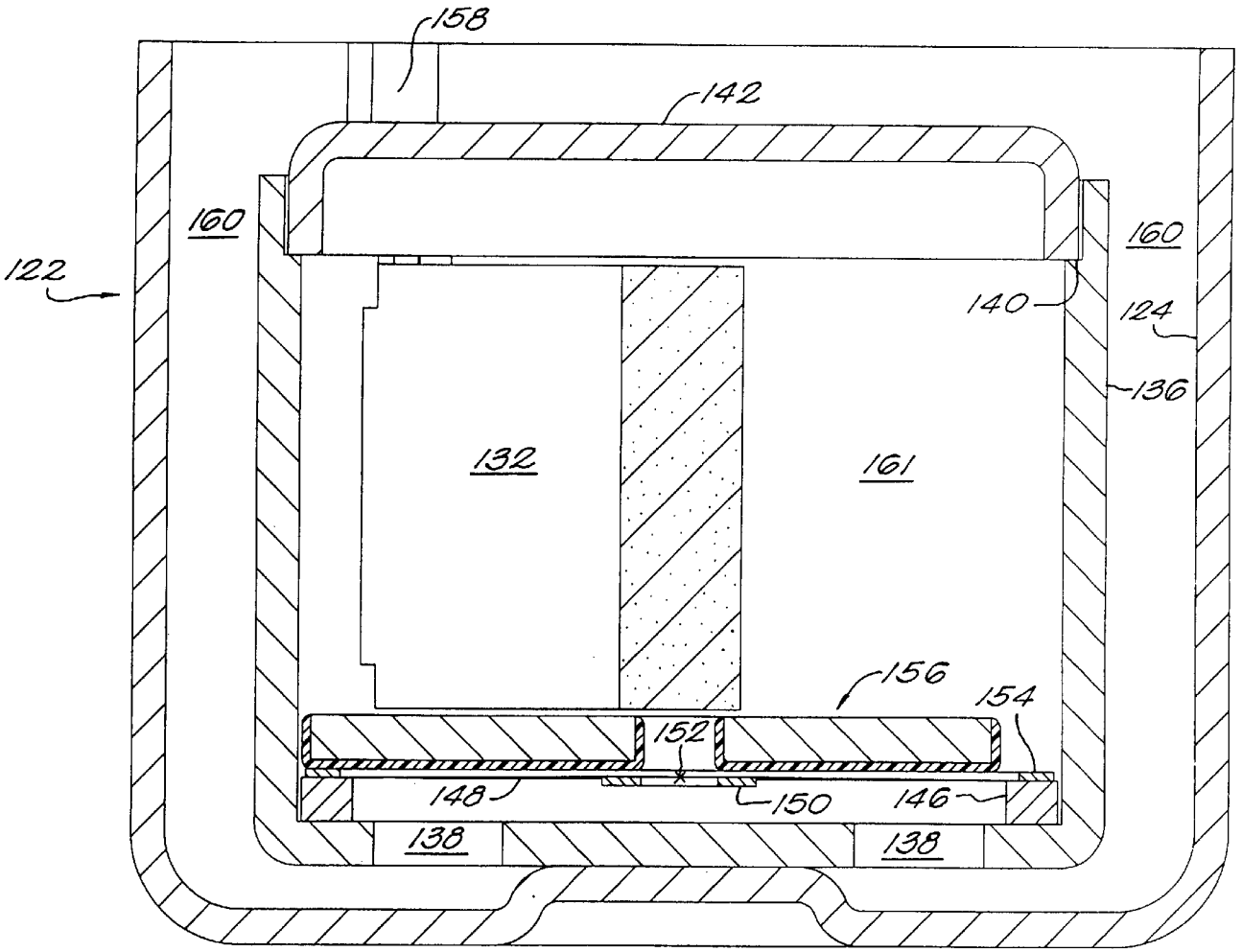
FIG. 13 is an elevation in section of the microphone in the embodiment of FIG. 12.

An alternative embodiment of the microphones of the present invention is shown at 122 in FIGS. 12 and 13. This embodiment is intended to be mounted as in FIG. 11, but with the recess in the faceplate fitting the cross sectional shape of an outer casing 124. FIG. 13 is a section of the microphone 122 as cut by a plane containing the central axis of the microphone and a diagonal passing through points 126—126 shown in FIG. 12.

The outer casing 124 is provided with a slot 128, recessed on one side as shown at 130, to receive by axial translation a circuit and terminal board 132. The board 132, typically of a high alumina ceramic, has a multiplicity of terminal pads at 134 for solder connections, and surface conductors on the board running from the terminal pads into the interior of the microphone under the recess 130, which prevents shorting of the conductors, The microphone 122 also has an inner casing 136 which, when assembled, is welded into the outer casing 124. The inner casing 136 has four acoustic apertures 138, and is pinch coined at 140 to receive and locate a cap 142. The inner casing 136 is slotted with the same pattern as the recessed slot 128, 130 on the side adjacent thereto. On the opposite end of its diameter the casing 136 is slotted as at 144 with the pattern of the slot 128 but without the recess 130. Prior to placement of the cap 142, the board 132 and the semiconductor and other circuitry (not shown) mounted on it, may be slid axially into the slots, the slots in both casings locating and supporting the board.

The inside radius of the inner casing 136 is sharpened in a secondary operation to receive a diaphragm tensioning and support ring 146. To this is adhesive bonded under tension a gold coated diaphragm 148, which carries an additional ring mass or washer 150, and also has an atmospheric pressure vent aperture 152. The diaphragm subassembly is bonded into the inner casing 136 with silver epoxy at the metallic ring 146. A shim washer 154 spaces between the rim of the diaphragm 148 and the tabs of an electret film coated backplate 156 of the form shown in FIG. 8. The backplate 156 is fixed to the inner casing 136 by insulating epoxy paste adhesive fillets (not shown) onto the metallic surfaces of the backplate's three tabs.

Electrical contact to an input conductor at an edge of the board 132 is made by a silver epoxy fillet to the exposed metallic surface of the backplate. Likewise, the ground contact between the appropriate conductor on the board 132 and the inner casing 136 is made by a silver epoxy fillet. Typically the inner casing 136 and the metallic portion of the backplate 156 are gold plated for this purpose, and typically the conductors on the board 132 are noble metal frit bonded coatings fired at high temperature.

The cap 142 has the filler key 158 welded onto it. When the assembly of the microphone 122 is completed by adhesive bonding of the cap 142 in place against the step of the pinch coin 140, the key 158 substantially fills the remainder of the slot left by the board 132. Sufficient adhesive must be used to block all potential leaks, except the vent aperture, between all of the corner spaces 160 and the exterior of the microphone 122 or the interior space 161. In particular, sufficient adhesive must be used to block the remainder of the slot 144 and the recesses 130 in both of the casings 124 and 136.

Figure 14:
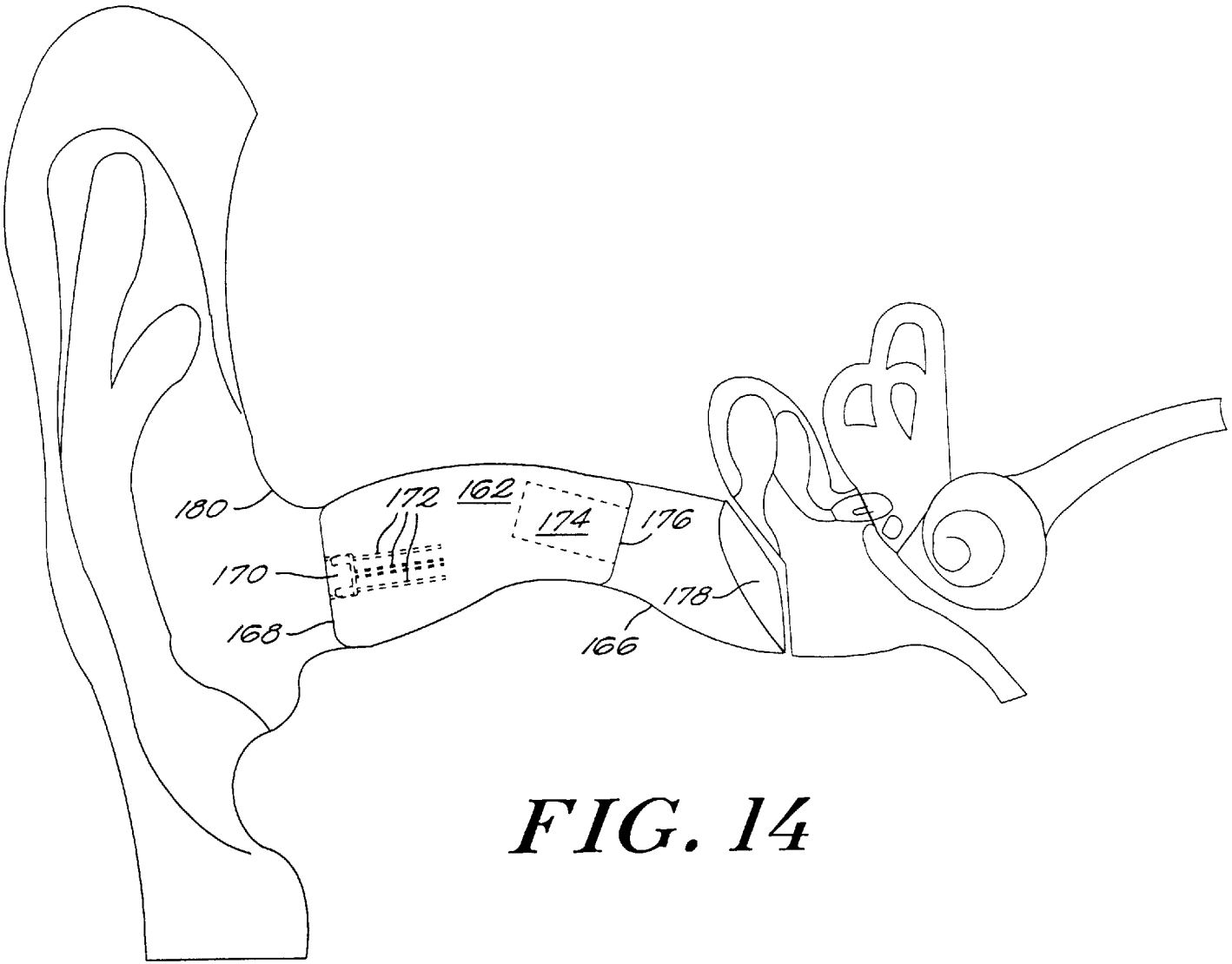
FIG. 14 is a schematic view of a first form of CIC aid according to the invention.
Figure 15:
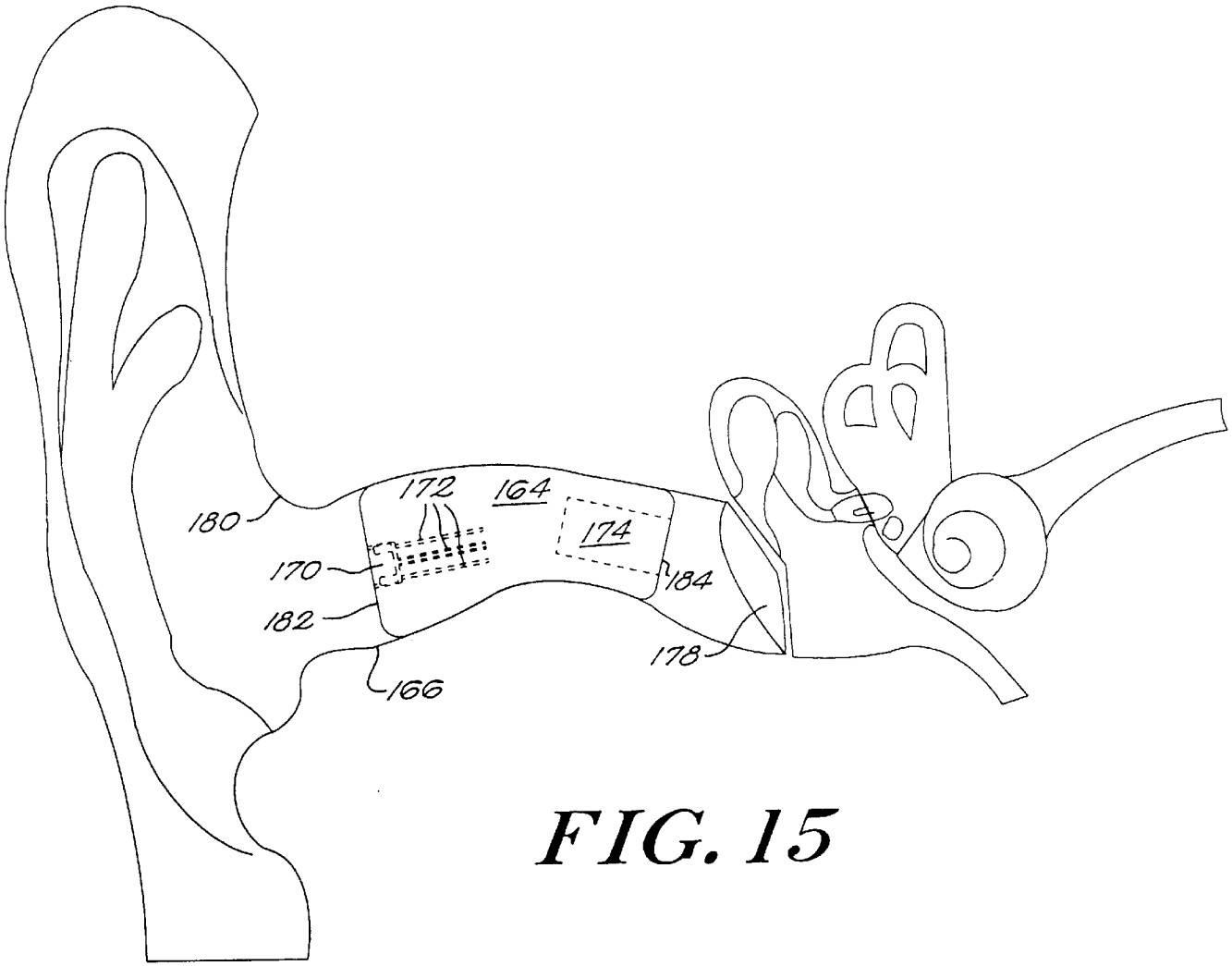
FIG. 15 is a schematic view of a second form of CIC aid according to the invention.

FIGS. 14 and 15 illustrate schematically the application of the microphones of the present invention to CIC hearing aids. CIC hearing aids 162 and 164, respectively, are shown in position in the auditory meatus 166 of the user.

In FIG. 14 the outer face 168 of a faceplate of the CIC aid 162 is roughly flush with the outer terminus of the meatus 166. A microphone 170 is flush mounted in the faceplate as in FIG. 4 or FIG. 10, and is located more or less centrally on the outer face 168. Flex leads 172 of the microphone 170 are shown schematically as in FIG. 5 or FIG. 9, and the interior of the faceplate of CIC aid 162 is not indicated. The receiver elements 174 of the aid 162, the cause of its vibration, are located at or near the end 176 toward the tympanic membrane 178. The specific acoustic radiation impedance, as defined above, of the outer face 168 of the CIC aid 162 is typically less than that of a typical canal aid because of the smaller area of the face 168, even though there is additional air mass in the concha cavum 180. During vibration of the aid 162, the microphone 170 senses the resulting radiation pressure, in addition to its internal inertial effects, over the annular inlet, essentially at the effective center of the outer face 168. When the added mass 44 (FIG. 4*a*) of the microphone 170 is appropriately chosen, say from a discrete set of choices for practical reasons, the total acceleration induced signal of the microphone 170 is much reduced compared with prior art microphones over a very substantial frequency range.

In FIG. 15 the CIC aid 164 is mounted with its outer face 182 inward of flush, and its inner end 184 is inserted more deeply toward the tympanic membrane 178. Generally the specific acoustic radiation impedance of the outer face 182 will be greater than that of the outer face 168 of FIG. 14, as a result of the further additional air mass in the auditory meatus 166 between the outer face 182 and the concha cavum 180.

When the user of an ITE hearing aid incorporating a microphone system of this invention attempts to use a telephone while the aid is in acoustic mode, the hearing aid is apt to go into oscillation, particularly if this microphone system is necessary to avoid oscillation in normal use. This is because the complex radiation impedance such as Rs+iXs is considerably affected by the proximity of the telephone's receiver, Consequently a telecoil mode is needed in hearing aids of this type. Such hearing aids will tend to be cosmetically acceptable, and often quite inaccessible when worn, so switching between acoustic mode and telecoil mode will be most convenient if done by remote or accomplished automatically.

In the foregoing description references are made to specific applications of the invention to hearing aids. However, it is not inherently limited to such applications. For example, references are made to a "faceplate." In microphone applications other than hearing aids the faceplate described herein may be replaced by a frame, outer casing, support or other structure housing or retaining a microphone and structured according to the teachings of this invention as herein described and claimed. Accordingly, the term "faceplate" is intended to include generically any such alternative or replacing means as well as hearing aid faceplates.

Likewise, although the invention has been described in relation to an air environment, other applications may involve its use in other acoustic transmitting media comprising the environment, such as other gases or liquids including water, for example.

What is claimed is:

1. A microphone comprising a transducer casing having a surface exposed to a sound propagating medium and partially enclosing an internal space, a diaphragm supported substantially at its periphery relative to the transducer casing, said diaphragm substantially completing the enclosure of said space, said space being located between the diaphragm and said exposed surface, means forming a principal acoustic signal passage extending between the vicinity of said exposed surface and the surface of the diaphragm external to said internal space, and means supported within the transducer casing and responsive to motion of the diaphragm relative to the casing to generate an electrical signal, whereby in response to mechanical vibratory acceleration of the microphone its radiation reactance in said sound propagating medium, augmented by the mass of the acoustic medium in said passage, tends to produce unwanted electrical signals, the effective inertial mass of the diaphragm being adapted to cause a substantial degree of cancellation of said unwanted signals over a useful frequency band.

2. A microphone according to claim 1, in which the microphone includes an electret coated backplate, and retainer means to support the diaphragm and backplate in mutually spaced relationship.

3. A microphone according to claim 1, in which said responsive means is located within said internal space.

4. A microphone according to claim 1, in which said passage includes an external space on the side of the diaphragm opposite to said internal space, the transducer casing partially enclosing said external space.

5. An electroacoustic assembly comprising a microphone having a transducer casing partially enclosing an internal space, a diaphragm supported substantially at its periphery relative to the transducer casing, said diaphragm substantially completing the enclosure of said space, and means supported within the transducer casing and responsive to motion of the diaphragm relative to the casing to generate an electrical signal, and a faceplate having a surface exposed to a sound propagating medium, the microphone being secured to the faceplate with said internal space located between the diaphragm and said exposed surface, said assembly having a principal acoustic signal passage extending between said exposed surface and the surface of the diaphragm external to said internal space, whereby in response to mechanical vibratory acceleration of the faceplate its radiation reactance in said sound propagating medium, augmented by the mass of the acoustic medium in said passage, tends to produce unwanted electrical signals, the effective inertial mass of the diaphragm being adapted to cause a substantial degree of cancellation of said unwanted signals over a useful frequency band.

6. An assembly according to claim 5, in which the microphone includes an electret coated backplate, and retainer means to support the diaphragm and backplate in mutually spaced relationship.

7. An assembly according to claim 5, in which said responsive means is located within said internal space.

8. An assembly according to claim 5, in which said passage includes an external space on the side of the diaphragm opposite to said internal space, said transducer casing partially enclosing said external space.

9. An assembly according to claim 5, in which the faceplate has an aperture and the transducer casing is received in said aperture, said passage including spaces formed between the casing and the aperture.

10. An assembly according to claim 9, in which the transducer casing includes wall portions forming ridges fitted to said aperture.

11. An assembly according to claim 10, in which said responsive means includes a plurality of electrical leads each extending within a ridge to the exterior of the transducer casing, the diaphragm extending internally of said leads.

12. A microphone according to claim 1, in which the transducer casing includes a plurality of wall portions forming substantially parallel ridges, and electrical leads each extending within each of said ridges from said internal space to the exterior of the transducer casing, the diaphragm extending internally of said leads.

13. An assembly according to claim 5, in which an external wall of the transducer casing is substantially flush with said exposed surface of the faceplate.

14. A hearing aid comprising a microphone having a transducer casing partially enclosing an internal space, a diaphragm supported substantially at its periphery relative to the transducer casing, said diaphragm substantially completing the enclosure of said space, and transducer means supported within the transducer casing and responsive to motion of the diaphragm relative to the casing to generate an electrical signal, a faceplate having a surface exposed to a sound propagating medium, the microphone being secured to the faceplate with said internal space located on the side of the diaphragm toward said exposed surface, means forming a principal acoustic signal passage extending between said exposed surface and the surface of the diaphragm external to said internal space, a receiver operatively connected to said microphone and responsive to said signal to produce an acoustic output, and means connecting with the faceplate and partially enclosing and mechanically coupling the microphone and receiver, whereby in response to mechanical vibratory acceleration of the hearing aid its radiation reactance in said sound propagating medium, augmented by the mass of the acoustic medium in said passage, tends to provide unwanted electrical signals to said receiver, the effective inertial mass of the diaphragm being adapted to cause a substantial degree of cancellation of said unwanted signals over a useful frequency band.

15. A hearing aid according to claim 14, in which the microphone includes an electret coated backplate, and retainer means to support the diaphragm and backplate in mutually spaced relationship.

16. A hearing aid according to claim 14, in which said responsive means is located within said internal space.

17. A hearing aid according to claim 14, in which said passage includes an external space on the side of the diaphragm opposite to said internal space, said transducer casing partially enclosing said external space.

18. An assembly according to claim 5, including an outer casing secured to the faceplate, the transducer casing being secured within the outer casing, said passage extending in part between surfaces of the outer casing and the transducer casing.

19. A microphone according to claim 1, including an added mass attached to the diaphragm to increase its reactance to vibration.

20. A microphone according to claim 1, in which said internal space has an atmospheric pressure vent communicating with said sound propagating medium and having over said frequencies an acoustic impedance sufficiently high to substantially suppress acoustic signal flow through the vent.

21. An in-the-ear hearing aid comprising a structure having a surface subject to mechanical vibratory acceleration and insertable in the ear with said surface facing outwardly of the ear and exposed to external acoustic signals, a microphone having a diaphragm supported therein, the diaphragm having a surface facing generally inwardly of the ear and the microphone being mechanically coupled to said structure, a principal acoustic signal passage for said external signals extending to said surface of the diaphragm, and means responsive to vibrations of the diaphragm relative to the microphone to produce electrical output signals, the effective inertial mass of the diaphragm being adapted to cause a substantial reduction over a usefull frequency band of those electrical output signals which result from said mechanical vibratory acceleration.

22. A hearing aid according to claim 21, including means comprising an electroacoustic receiver and adapted to convert said electrical signals to amplified acoustic signals transmitted to the tympanic membrane of the ear.

23. A hearing aid according to claim 22, in which the receiver is mechanically coupled to said structure.

24. A hearing aid according to claim 21, in which said structure defines an aperture open to said external acoustic signals and communicating with said passage.

25. A hearing aid according to claim 21, in which said structure and said microphone define an aperture open to said external acoustic signals and communicating with said passage.

26. A hearing aid according to claim 21, in which said passage is open to said external acoustic signals near said structural surface.

27. A hearing aid according to claim 21, in which said surface of the diaphragm substantially completes the enclosure of a space forming a portion of said passage.

28. A hearing aid according to claim 21, in which the microphone includes an electret coated backplate, the diaphragm and backplate forming an electret condenser transducer.

29. A hearing aid according to claim 21, in which the diaphragm comprises a film and a mass on the film to increase its reactance to vibration.

30. An electroacoustic microphone assembly comprising a support subject to mechanical vibratory acceleration and having an outwardly directed surface exposed to external acoustic sources, a diaphragm supported within the assembly and having a inwardly directed surface, means forming an acoustic passage extending from said exposed surface to said inwardly directed surface of the diaphragm, and transducer means connected to the diaphragm and adapted to produce electrical signals in response to the acoustic signals traversing said passage, whereby in response to said mechanical vibratory acceleration the radiation reactance of said exposed surface of the support, augmented by the mass of the acoustic medium in said passage, tends to produce unwanted electrical output signals of the microphone assembly, the effective inertial mass of the diaphragm being adapted to cause a substantial degree of cancellation of said unwanted signals over at least one useful frequency band.

31. The assembly according to claim 30, wherein said assembly has a vent connecting between the atmosphere and the surface of the diaphragm opposite to said inwardly directed surface, said vent having over said frequencies an acoustic impedance sufficiently high to substantially suppress acoustic signal flow through the vent.

32. The assembly according to claim 30, including a casing attached to said support, the diaphragm being supported relative to the casing.

33. The assembly according to claim 32, in which the casing has a surface exposed to external acoustic sources.

34. The assembly according to claim 33, in which said acoustic passage extends in part between surfaces of said support and said casing.

35. The assembly according to claim 32, including an outer housing attached to said support, said casing being contained between the outer housing and said support, said acoustic passage extending in part between surfaces of said outer housing and said casing.

36. The assembly according to claim 30, in which said assembly is substantially housed within said support.

37. The assembly according to claim 30, in which the support is formed for insertion in the ear.

38. The assembly according to claim 32, in which the support is formed for insertion in the ear and the position of the casing in the assembly is intended for location within the auditory meatus.

39. The assembly according to claim 37, including means comprising an electroacoustic receiver mechanically coupled to said support, said means enabling the conversion of the total electrical output signal of the microphone assembly to a corresponding amplified acoustic output signal from the receiver, and, means forming with said support a substantial enclosure for said microphone assembly and receiver means.

40. The assembly according to claim 30, in which the self mass of the diaphragm is sufficient for said substantial degree of cancellation of said unwanted signals.

41. The assembly according to claim 30, including a mass attached to The diaphragm, said mass being otherwise free to vibrate relative to the support of the diaphragm.

42. The assembly according to claim 30, in which the diaphragm is an operative part of said transducer means.

43. A heating aid comprising, in combination, (1) a housing having a vibrating surface and formed for insertion in the ear with said surface directed outwardly of the ear and exposed to acoustic vibratory pressure, (2) a microphone assembly including (a) a diaphragm supported within the assembly and having an inwardly directed surface, (b) means forming an acoustic passage extending from said vibrating surface To said inwardly directed surface of the diaphragm, and (c) transducer means associated with the diaphragm and adapted to produce electrical signals in response to vibrations of the diaphragm relative to its support, and (3) electroacoustic receiver means mechanically coupled to said housing and operatively connected to said transducer means to convert said electrical signals to amplified acoustic signals, whereby in response to mechanical vibratory acceleration of said receiver means the radiation reactance of said vibrating surface, augmented by the mass of the acoustic medium in said passage, tends to produce unwanted components of said amplified acoustic signals, the effective inertial mass of the diaphragm being adapted to cause a substantial degree of cancellation of said unwanted components over a useful frequency band.

44. The hearing aid according to claim 43, in which the amplification of the hearing aid is sufficient to cause self sustained oscillation thereof in the absence of said substantial degree of cancellation of said unwanted components.

45. A sound amplification system comprising a microphone for converting signals from external acoustic sources to electrical signals, an electroacoustic sound generating transducer, a structure mechanically coupling the microphone and transducer and having a vibrating surface, said structure being disposable with said surface directed outwardly to be exposed to said external acoustic sources, the microphone having a diaphragm supported therein and means responsive to vibrations of the diaphragm relative to its support to produce said electrical signals, the diaphragm having an inwardly directed surface, and means forming a primary acoustic signal passage extending to said inwardly directed surface of the diaphragm, and means operatively connecting the microphone to the transducer to provide amplified acoustic output signals in response to said electrical signals and concomitantly to cause mechanical vibrations of the transducer, the effective inertial mass of said diaphragm being adapted to cause a substantial reduction over a useful frequency band of those acoustic output signals which result from said mechanical vibrations of the transducer transferred to said vibrating surface, and from The radiation impedance thereof.

* * * * *